US007863816B2

(12) United States Patent
Reich et al.

(10) Patent No.: US 7,863,816 B2
(45) Date of Patent: Jan. 4, 2011

(54) DIELECTRIC BARRIER DISCHARGE LAMP

(75) Inventors: Lajos Reich, Budapest (HU); József Tökés, Budapest (HU)

(73) Assignee: General Electric Company, Schenectady, NY (US)

( * ) Notice: Subject to any disclaimer, the term of this patent is extended or adjusted under 35 U.S.C. 154(b) by 1852 days.

(21) Appl. No.: 10/692,108

(22) Filed: Oct. 23, 2003

(65) Prior Publication Data

US 2005/0088098 A1 Apr. 28, 2005

(51) Int. Cl.
*H01J 11/00* (2006.01)

(52) U.S. Cl. ..... 313/607; 313/491; 313/631

(58) Field of Classification Search ..... 313/491, 313/493, 607, 631, 634, 635
See application file for complete search history.

(56) References Cited

U.S. PATENT DOCUMENTS 4,530,710 A * 7/1985 Dullea et al. ..... 65/56
5,294,867 A * 3/1994 Grossman ..... 313/490
5,581,152 A 12/1996 Matsuno et al.
5,714,835 A 2/1998 Zachau et al.
6,034,470 A 3/2000 Vollkommer et al.
6,060,828 A 5/2000 Vollkommer et al.
6,246,171 B1 6/2001 Vollkommer et al.
6,304,028 B1 10/2001 Vollkommer et al.
6,522,084 B1 * 2/2003 Miyazaki et al. ..... 315/248
2002/0163312 A1 11/2002 Kling et al.

FOREIGN PATENT DOCUMENTS

EP 296535 A2 * 12/1988

* cited by examiner

*Primary Examiner*—Vip Patel
(74) *Attorney, Agent, or Firm*—Fay Sharpe LLP

(57) ABSTRACT

A dielectric barrier discharge lamp is disclosed, which has a discharge vessel enclosing with a wall a discharge volume filled with discharge gas. There is a phosphor layer within the discharge volume. The discharge lamp comprises first and second sets of interconnected electrodes, which are isolated from the discharge volume by at least one dielectric layer. At least one of the dielectric layers is the wall of the discharge vessel. Both the first and second sets of electrodes are located external to the discharge vessel. Advantageously, the discharge vessel comprises an outer tubular portion with an internal surface and an inner tubular portion with an outward surface. The outer tubular portion surrounds the inner tubular portion, and the discharge volume is enclosed between the internal surface of the outer tubular portion and the outward surface of the inner tubular portion.

30 Claims, 6 Drawing Sheets

Fig. 3
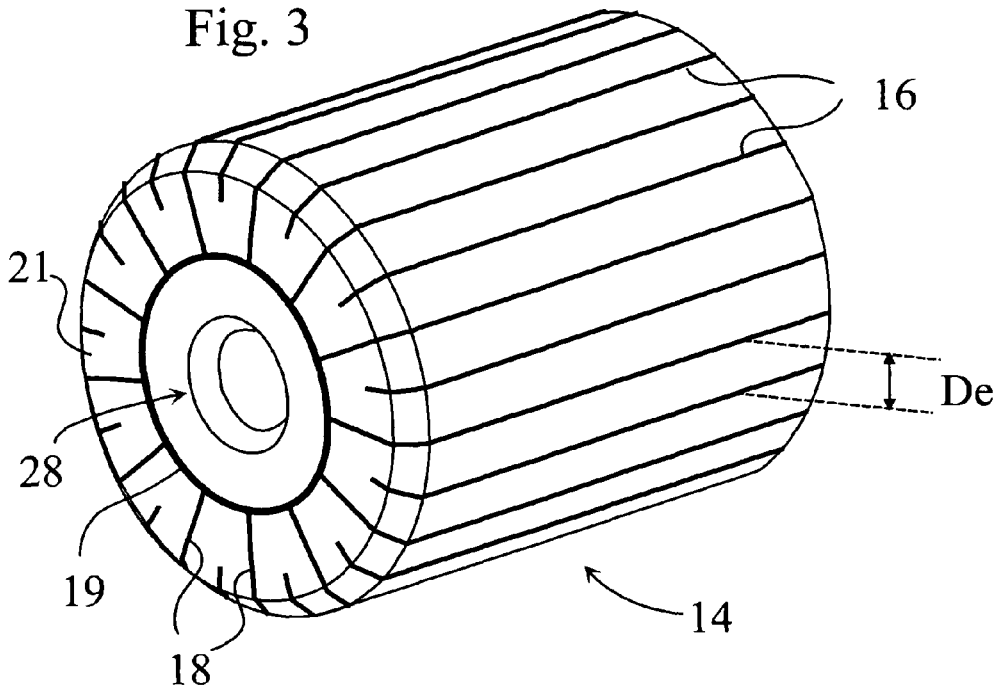
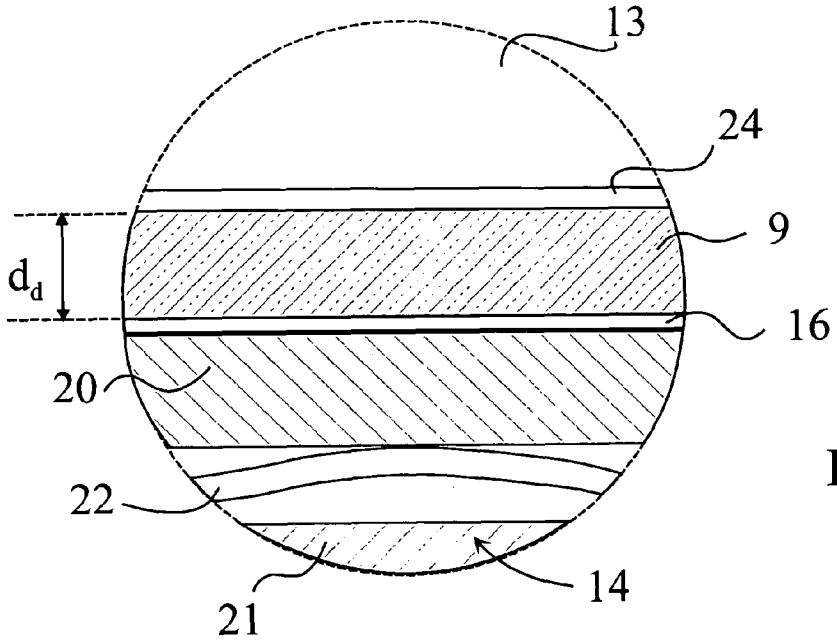
Fig. 4

Fig. 6
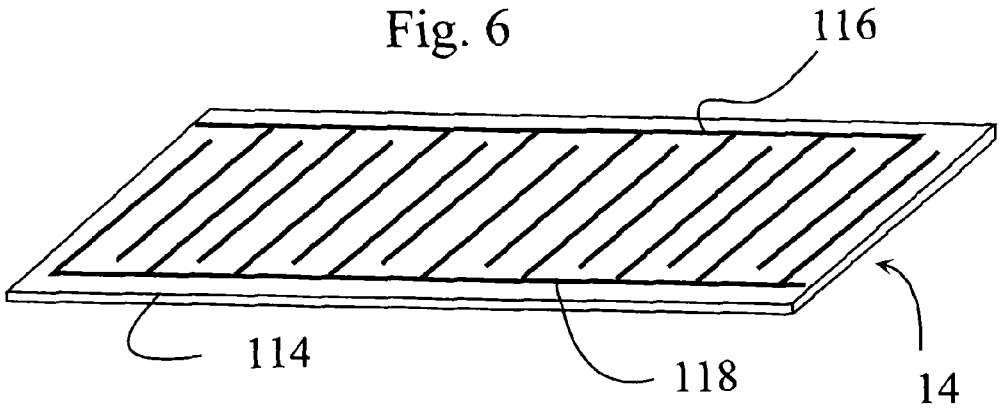
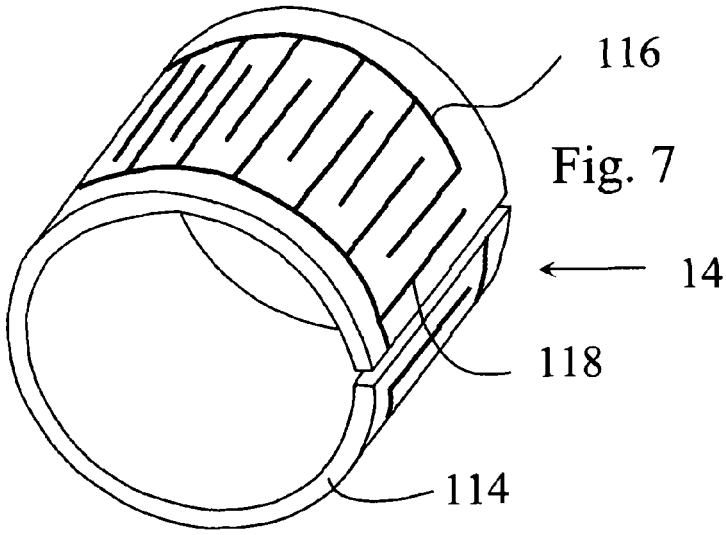
Fig. 7
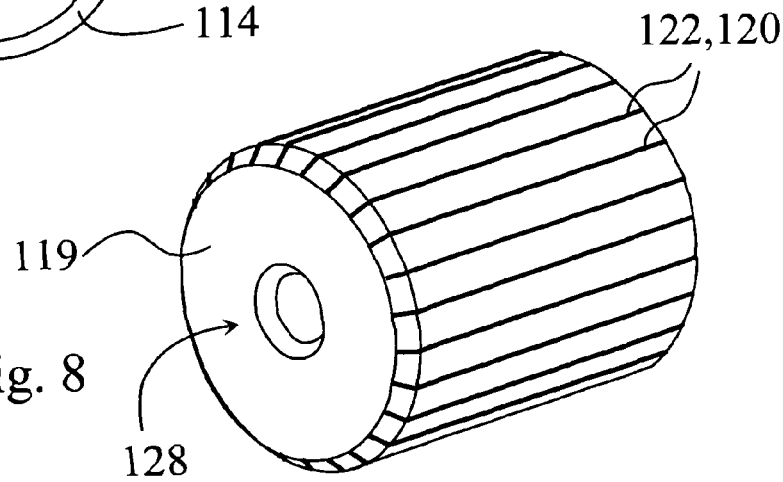
Fig. 8

DIELECTRIC BARRIER DISCHARGE LAMP

BACKGROUND OF THE INVENTION

This invention relates to a dielectric barrier discharge lamp.

Of the various low pressure discharge lamps known in the art, the majority are the so-called compact fluorescent lamps. These lamps have a gas fill which also contains small amounts of mercury. Since mercury is a highly poisonous substance, novel types of lamps are being recently developed. One promising candidate to replace mercury-filled fluorescent lamps is the so-called dielectric barrier discharge lamp (shortly DBD lamp). Besides eliminating the mercury, it also offers the advantages of long lifetime and negligible warm-up time.

As explained in detail in U.S. Pat. No. 6,060,828, the operating principle of DBD lamps is based on a gas discharge in a noble gas (typically Xenon). The discharge is maintained through a pair of electrodes, of which at least one is covered with a dielectric layer. An AC voltage of a few kV with a frequency in the kHz range is applied to the electrode pair. Often, multiple electrodes with a first polarity are associated to a single electrode having the opposite polarity. During the discharge, excimers (excited molecules) are generated in the gas, and electromagnetic radiation is emitted when the metastable excimers dissolve. The electromagnetic radiation of the excimers is converted into visible light by suitable phosphors, in a physical process similar to that occurring in mercury-filled fluorescent lamps. This type of discharge is also referred to as dielectrically impeded discharge.

As mentioned above, DBD lamps must have at least one electrode set which is separated from the discharge gas by a dielectric. Various electrode configurations have been proposed to satisfy this requirement. U.S. Pat. Nos. 6,034,470 and 6,304,028 disclose two different DBD lamp configurations, where both set of electrodes are located within a discharge vessel, which confines the discharge gas atmosphere. The electrodes are covered with a thin layer of dielectric. None of these lamp configurations are suitable for a low-cost mass production.

U.S. Pat. No. 5,714,835 and US Patent Application Publication No. US 2002/0163312A1 disclose DBD lamp configurations where a tubular discharge vessel includes a first electrode, which is located within the discharge vessel and surrounded by the discharge gas, while a second set of electrodes are placed external to the discharge vessel. A similar electrode configuration is disclosed in the above mentioned U.S. Pat. No. 6,060,828, both for a substantially plane and for a tubular discharge vessel.

These latter arrangements have the advantage that at least one set of electrodes need no particular insulation, but may be applied relatively simply to the outside of the discharge vessel. However, these electrodes are visually inattractive, block a portion of the light, and also need to be insulated, due to the high voltage fed to them. Further, the other electrode is still located within the discharge vessel (i.e. within the sealed volume of the discharge vessel), which requires a sealed lead-through for that electrode.

Therefore, there is a need for a DBD lamp configuration with an improved electrode configuration, which is easy to manufacture and which does not interfere with the aesthetic appearance of the lamp. There is also need for an improved discharge vessel-electrode configuration which support the above goals. It is sought to provide a DBD lamp, which, beside having the required simplified electrode arrangement, is relatively simple and which does not require expensive components and complicated manufacturing facilities.

SUMMARY OF THE INVENTION

In an embodiment of the present invention, there is provided a dielectric barrier discharge lamp (DBD lamp), which comprises a discharge vessel. The discharge vessel encloses with a wall of the discharge vessel a discharge volume filled with discharge gas. The discharge vessel further encloses a phosphor layer within the discharge volume. The DBD lamp has a first set of interconnected electrodes and a second set of interconnected electrodes, which are isolated from the discharge volume by at least one dielectric layer. At least one of the dielectric layers is constituted by the wall of the discharge vessel. In an embodiment of the invention, both the first and second set of electrodes are located external to the discharge vessel. By the term "external" it is meant here that both the first and second set of electrodes are external to the volume which is sealed by the discharge vessel.

In an embodiment of another aspect of the invention, there is provided a discharge vessel for a DBD lamp. The discharge vessel encloses a sealed discharge volume. The discharge vessel comprises an outer tubular portion having an internal surface, and an inner tubular portion having an outward surface. The outer tubular portion surrounds the inner tubular portion, so that the sealed discharge volume is enclosed between the internal surface of the outer tubular portion and the outward surface of the inner tubular portion.

The disclosed DBD lamp ensures that the electrodes can be manufactured completely independently of the discharge vessel. No sealed lead-through for the electrodes are required. It is not required either to form a separate dielectric layer on the glass substrate constituting at the same time the wall of the discharge vessel, so the discharge vessel itself may be manufactured with a relatively simple, standard glass manufacturing equipment. More importantly, the electrodes remain completely hidden and invisible, so the overall aesthetic appearance of the lamp is undisturbed. The lamp provides a uniform and large illuminating surface.

BRIEF DESCRIPTION OF DRAWINGS

The invention will be now described with reference to the enclosed drawings, where FIG. 3 is a perspective view of the electrode support shown in FIG. 2, with an indication of the arrangement of the electrodes on the electrode support, FIG. 4 illustrates in an enlarged scale the detail indicated with IV in FIG. 2, FIG. 6 is a perspective view of another embodiment of an electrode support, FIG. 7 is a perspective view of the electrode support shown in FIG. 6, in a rolled-up state, for insertion into a discharge vessel similar to that shown in FIG. 2, FIG. 8 is a perspective view of a spring support for use with the electrode support shown in FIGS. 6 and 7.

DETAILED DESCRIPTION OF THE INVENTION

Figure 1:
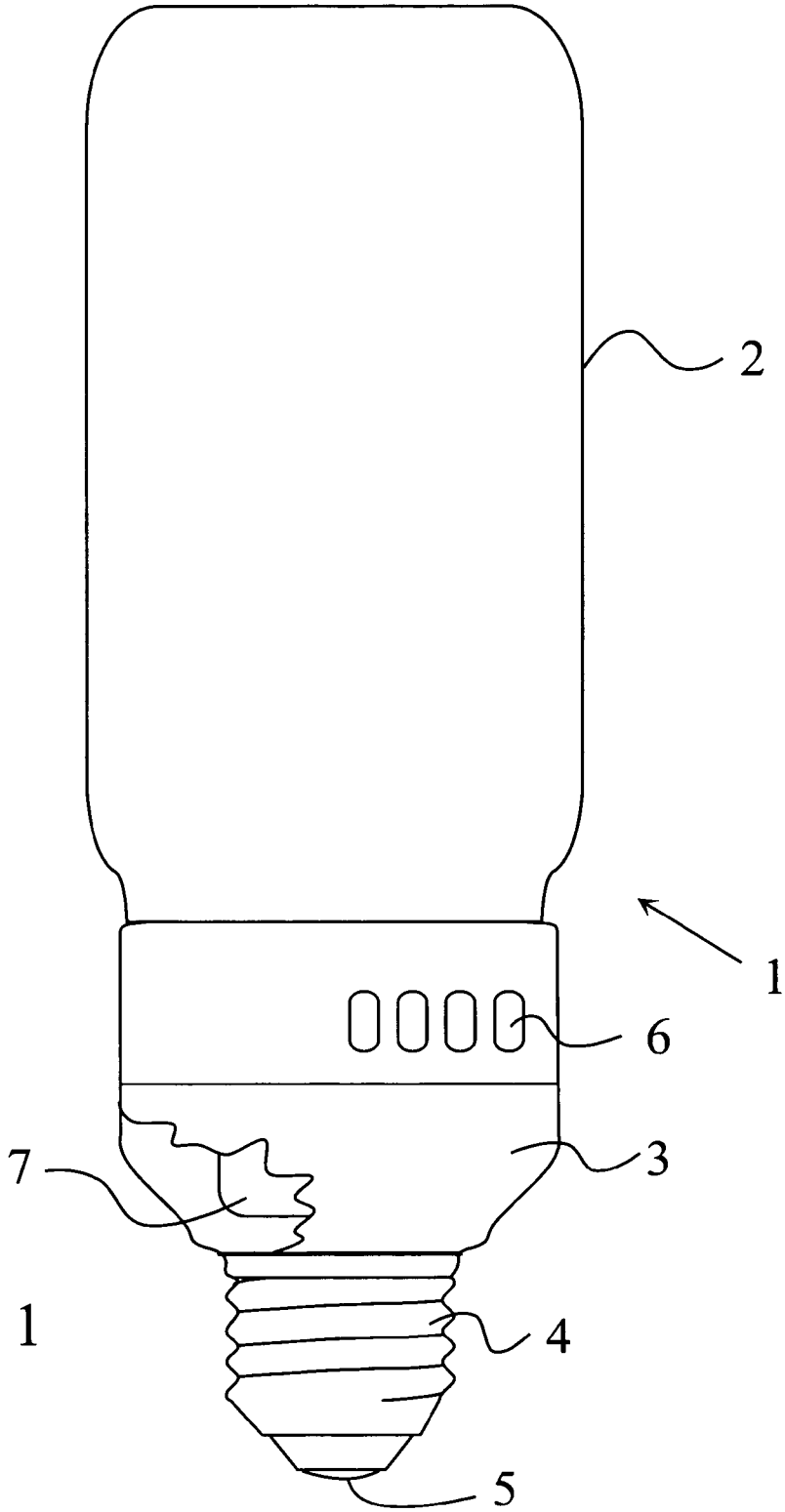
FIG. 1 is a side view of a dielectric barrier discharge lamp with an essentially tubular discharge vessel.

Referring now to FIG. 1, there is shown a low pressure discharge lamp 1. The lamp is a dielectric barrier discharge lamp (hereinafter also referred to as DBD lamp), with a discharge vessel 2, which in the shown embodiment has an externally visible envelope of a tubular shape, but, as will be explained with reference to FIG. 2, has actually a more complex shape. The discharge vessel 2 is mechanically supported by a lamp base 3, which also holds the contact terminals 4, 5 of the lamp 1, corresponding to a standard screw-in socket. The lamp base also houses an AC power source 7, illustrated only schematically. The AC power source 7 is of a known type, which delivers an AC voltage of 1-5 kV with 50-200 kHz AC frequency, and need not be explained in more detail. The operation principles of power sources for DBD lamps are disclosed, for example, in U.S. Pat. No. 5,604,410. As shown in the embodiment of FIG. 1, ventilation slots 6 may be also provided on the lamp base 3.

Figure 2:
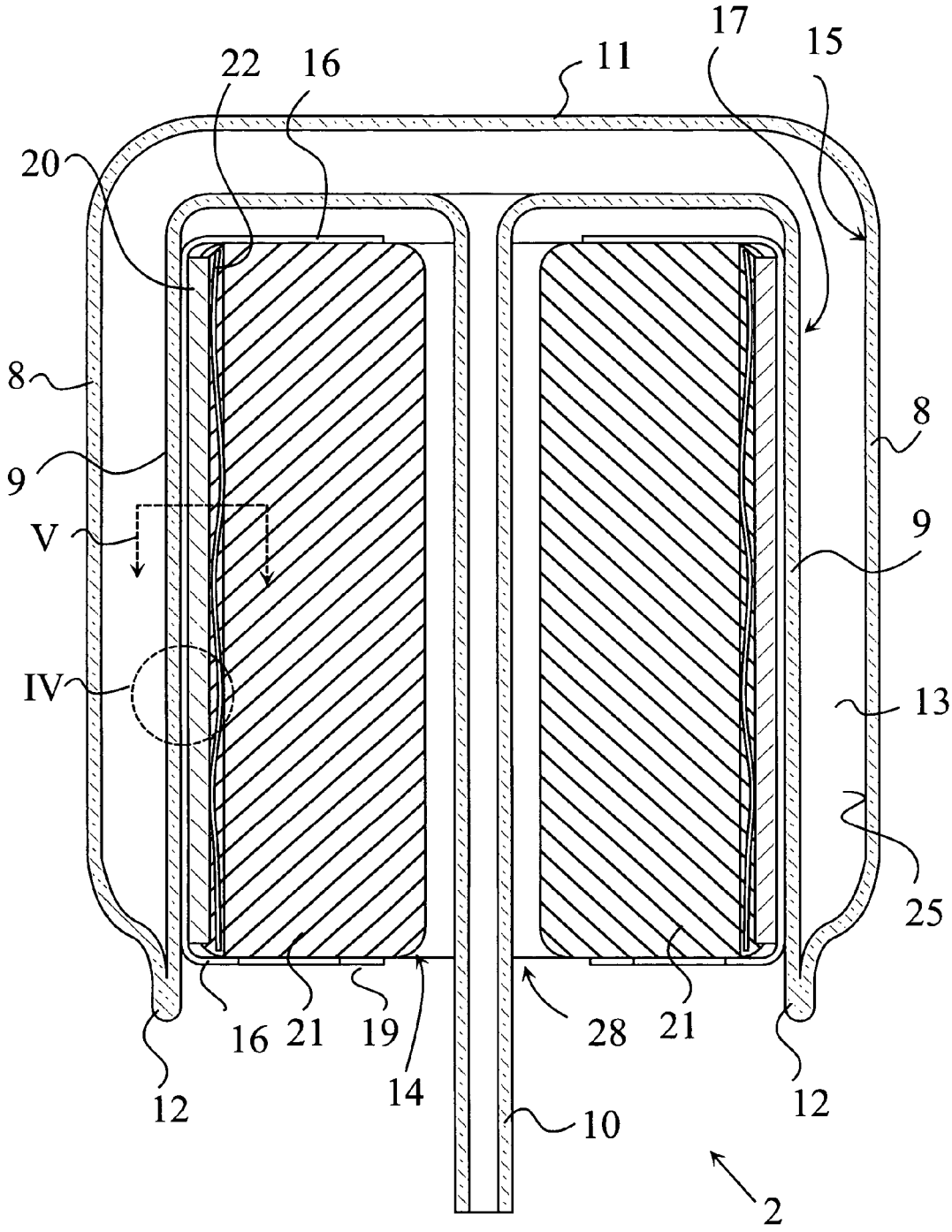
FIG. 2 is a cross section of a discharge vessel similar to that of the lamp shown in FIG. 1, with electrodes and an electrode support within the discharge vessel.

The internal structure of the discharge vessel 2 of the DBD lamp 1 is explained with reference to FIGS. 2-5. It must be noted that the discharge vessel 2 shown in FIG. 2 is somewhat shorter in axial direction than the discharge vessel 2 shown in FIG. 1. The wall of the discharge vessel 2 encloses a discharge volume 13, which is filled with discharge gas. In the shown embodiment, the shape of the external envelope of the discharge vessel 2 is determined by an outer tubular portion 8 and an end portion 11, which closes the outer tubular portion 8 from one end (top end in FIG. 2). The outer tubular portion 8 has an internal surface 15.

As best seen in FIG. 2, the discharge vessel resembles a double-walled structure, because it also has an inner tubular portion 9, with an outward surface 17. The outer tubular portion 8 and the inner tubular portion 9 are substantially concentric with each other, in the sense that the outer tubular portion 8 surrounds the inner tubular portion 9. The inner and outer tubular portions 9, 8 are joined at their common end 12. In this manner, the discharge volume 13 is in fact enclosed between the internal surface 15 of the outer tubular portion 8 and the outward surface 17 of the inner tubular portion 9. The joint at the end 12 is sealed, and thereby the discharge volume 13 is also sealed.

The discharge vessel 2 is made of glass. The wall thickness $d_d$ of the inner tubular portion 9 is approx. 0.5 mm. As it will be explained below, the wall of the inner tubular portion 9 also plays a role as the dielectric in the dielectric barrier discharge. Therefore, it is desirable to use a relatively thin wall for the inner tubular portion 9. The distance between the internal surface 15 of the outer tubular portion 8 and the outward surface 17 of the inner tubular portion 9 is approx. 5 mm, but in other embodiments it may vary, preferably between 3-11 mm.

In order to be able to manufacture the discharge vessel 2 with standard glass bulb manufacturing technology, the inner tubular portion 9 also comprises an exhaust tube 10. This exhaust tube 10 communicates with the discharge volume 13, and the discharge volume 13 may be evacuated and subsequently filled with a low pressure discharge gas through the discharge tube 10 in a known manner. In FIG. 2, the discharge tube 10 is still open, but in a finished lamp 1 it is tipped off, also in a manner known, maintaining the low pressure and sealing the discharge volume 13. As mentioned above, one end of the outer tubular portion 8 is closed with an end portion 11. The exhaust tube 10 extends along the central principal axis of the inner tubular portion 9, so that a free end of the exhaust tube 10 is opposite to the closed end of the outer tubular portion 8.

In order to provide a visible light, the internal surface 15 and also the internal surface of the end portion 11 is covered with a phosphor layer 25. This phosphor layer 25 is within the sealed discharge volume 13. The efficiency of the lamp may be improved if also the outward surface 17 is covered with a phosphor layer, or, as shown in the figures, with a reflective layer 24. The reflective layer 24 is reflective in the UV or visible wavelength ranges, reflecting on one hand the UV radiation emanating from the discharge towards the phosphor layer 25, on the other hand it also may reflect the visible light outward from the discharge vessel 2.

The dielectric barrier discharge (also termed as dielectrically impeded discharge) is generated by a first set of interconnected electrodes 16 and a second set of interconnected electrodes 18. The term "interconnected" indicates that the electrodes are on a common electric potential, i.e. they are connected with each other within a set. The interconnection layout of the electrodes 16 and 18 is illustrated in FIG. 3.

The first set of the electrodes 16 and the second set of electrodes 18 are formed as elongated conductors. For example, these elongated conductors may be formed of metal stripes or metal bands, which extend along the principal axis of the inner tubular portion 9. The metal stripes constituting the electrodes 16 and 18 are supported by an electrode support 14 in the form of a cylinder 21, illustrated in FIG. 3. On one end of the electrode support 14, a ring terminal 19 interconnects the electrodes 16 of the first set. A similar ring terminal (not shown) at the other end of the electrode support 14 interconnects the electrodes 18 of the second set. The electrode support 14—here formed as a cylinder 21—is inserted into the inner tubular portion 9, so that the exhaust tube 10 goes through a bore 28 of the cylinder 21. FIG. 2 illustrates the electrode support 14 in its inserted position. In this manner, the electrodes 16 and 18 are distributed along the internal surface of the inner tubular portion 9 uniformly and alternating with each other. In the shown embodiment, the distance De between two neighboring electrodes of opposite sets is approx. 3-5 mm.

On the other hand, the electrodes 16 and 18 are isolated from the discharge volume 13 by at least one dielectric layer. In the DBD lamp shown in the figures, at least one of the dielectric layers is constituted by the wall of the discharge vessel 2. More precisely, it is the inner tubular portion 9 which serves as the dielectric layer. The dielectric layer need to be as thin as possible to be able to generate a discharge, and therefore the electrodes 16 and 18 are located at the internal surface of the inner tubular portion 9, to bring them as close to the discharge volume 13 as possible. However, with this embodiment, both the first and second set of the electrodes 16 and 18 are located external to the discharge vessel 2. Here the term "external" indicates that the electrodes 16 and 18 are outside of the sealed volume enclosed by the discharge vessel 2. This means that the electrodes 16 and 18 are not only separated from the discharge volume 13 with a thin dielectric layer, but it is actually the wall of the discharge vessel 2—presently the inner tubular portion 9—which separates them from the discharge volume 13, i.e. for both sets of the electrodes 16 and 18 the wall of the discharge vessel 2 acts as the dielectric layer of a dielectrically impeded discharge. As mentioned above, in a possible embodiment the wall thickness $d_d$ of the discharge vessel 2 at the inner tubular portion 9 is approximately 0.5 mm. This thickness is a trade-off between the overall electric parameters of the lamp 1 and the mechanical properties of the discharge vessel 2.

As indicated in FIG. 2, a phosphor layer 25 covers the internal surface 15 of the outer tubular portion 8. The composition of such a phosphor layer 25 is known per se. This phosphor layer 25 converts the UV radiation of the excimer de-excitation into visible light. It is also possible to cover the outward surface 17 of the inner tubular portion 9 with a similar phosphor layer. Alternatively, as in the embodiments shown in the figures, the outward surface 17 of the inner tubular portion 9 may be covered with a reflective layer 24 reflecting in either in the UV or visible wavelength ranges, or in both ranges. Such a reflective layer 24 also improves the luminous efficiency of the lamp 1.

As indicated above, the electrodes 16 and 18 are externally located relative to the discharge vessel 2 in the lamp 1. Further, the electrodes 16 and 18 need not be bonded to the material of the discharge vessel 2. The only requirement is to bring them as close to the discharge volume 13 as possible. For example, in the lamp 1 shown in FIGS. 1 to 5, the electrodes 16 and 18 are mechanically supported by the cylinder 21, acting as an electrode support 14. This electrode support 14 is then inserted within the inner tubular portion 9. Since the electrode support 14, i.e. the cylinder 21 shown in FIGS. 2 to 5 is a tubular body made of an electrically insulating material, such as plastic, it may be held in place by form-fitting. However, glue or other methods to fasten the electrode support 14 within the inner tubular portion 9 are also contemplated.

Figure 5:
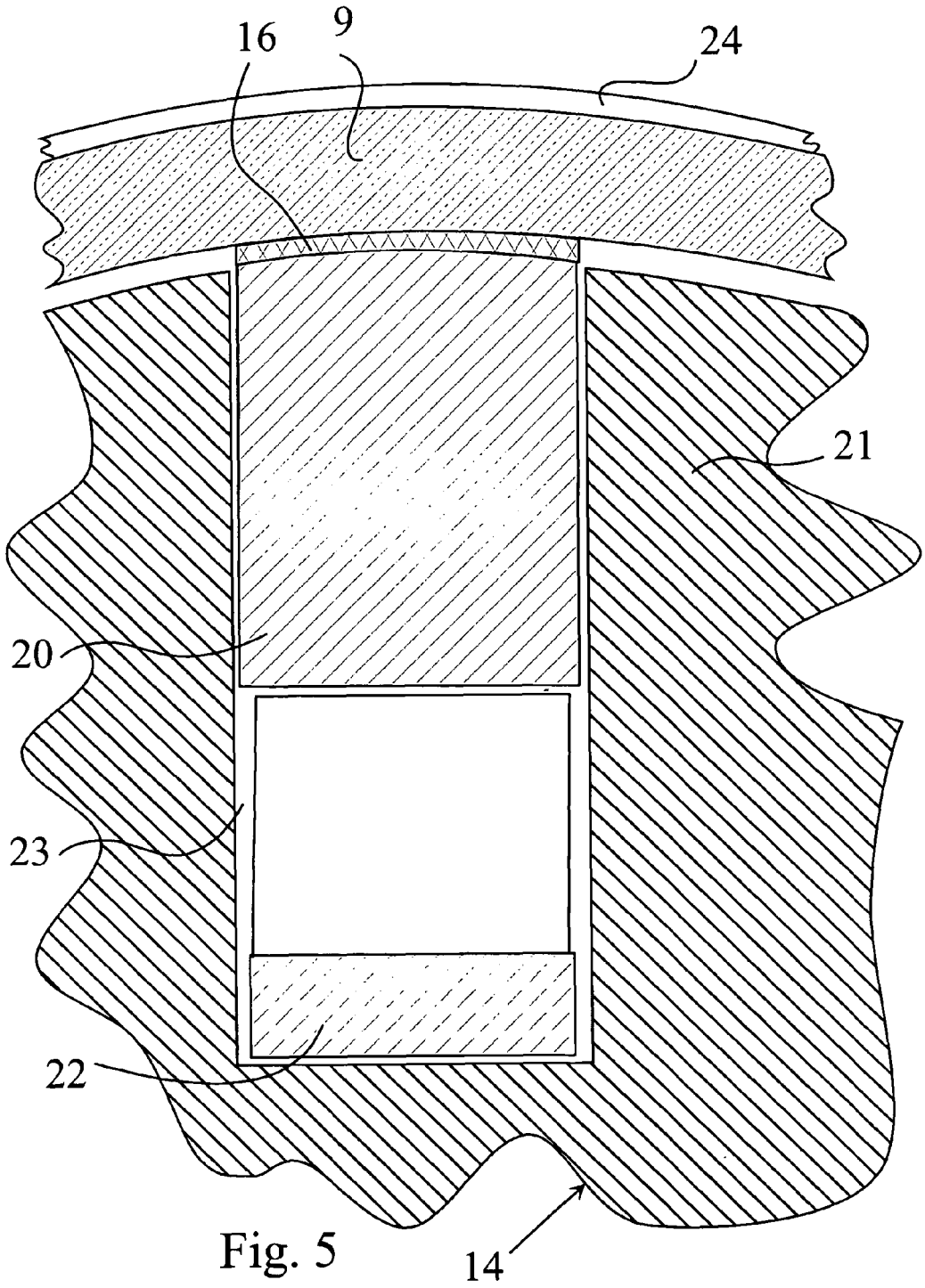
FIG. 5 is a cross-section in an enlarged scale of another detail, taken along the plane V indicated in FIG. 2.

In order to press the electrodes 16 and 18 to the internal surface of the inner tubular portion 9, it is foreseen to employ spring means for this purpose in the inner tubular portion 9, such as the springs 22 shown in FIGS. 2, 4 and 5. These springs 22 can be mechanically supported by the cylinder 21 functioning as the electrode support 14. In the shown embodiment, the electrode support 14 comprises elongated grooves 23 parallel to its principal axis, and the springs 22 are embedded in the grooves 23, which prevents their displacement along the perimeter of the electrode support 14.

As best seen in FIG. 5, an electrically insulating spacer 20 may be inserted between the spring 22 and the electrode associated to the respective spring 22, for example an electrode 16 in FIG. 5. The material of the spacer 20 can be plastic, such as polypropylene. This spacer 20 has a double purpose: it provides an electric insulation between the spring 22 and the electrode 16, and also provides a mechanical support for the electrode 16 itself. This latter function provides the advantage that the electrode 16 may be very thin in this manner, and thereby may have a smaller capacitance. The small capacitance of the electrodes facilitates the use of higher frequencies.

FIGS. 6 to 9 illustrate an alternative embodiment of the electrode support, showing an electrode support 14, which is formed as a sheet-like material, such as a foil 114. Again, the foil 114 is made of an electrically insulating flexible material, such as a suitable plastics material. The electrodes 116 and 118 may be applied to the surface of the foil 114 with known technologies. Similarly to the electrode support 14 shown in FIG. 3, the electrodes 116 and 118 on the foil 114 are formed as elongated conductors, for example thin wires or narrow bands of metal foil, which are distributed uniformly and alternating with each other.

Figure 9:
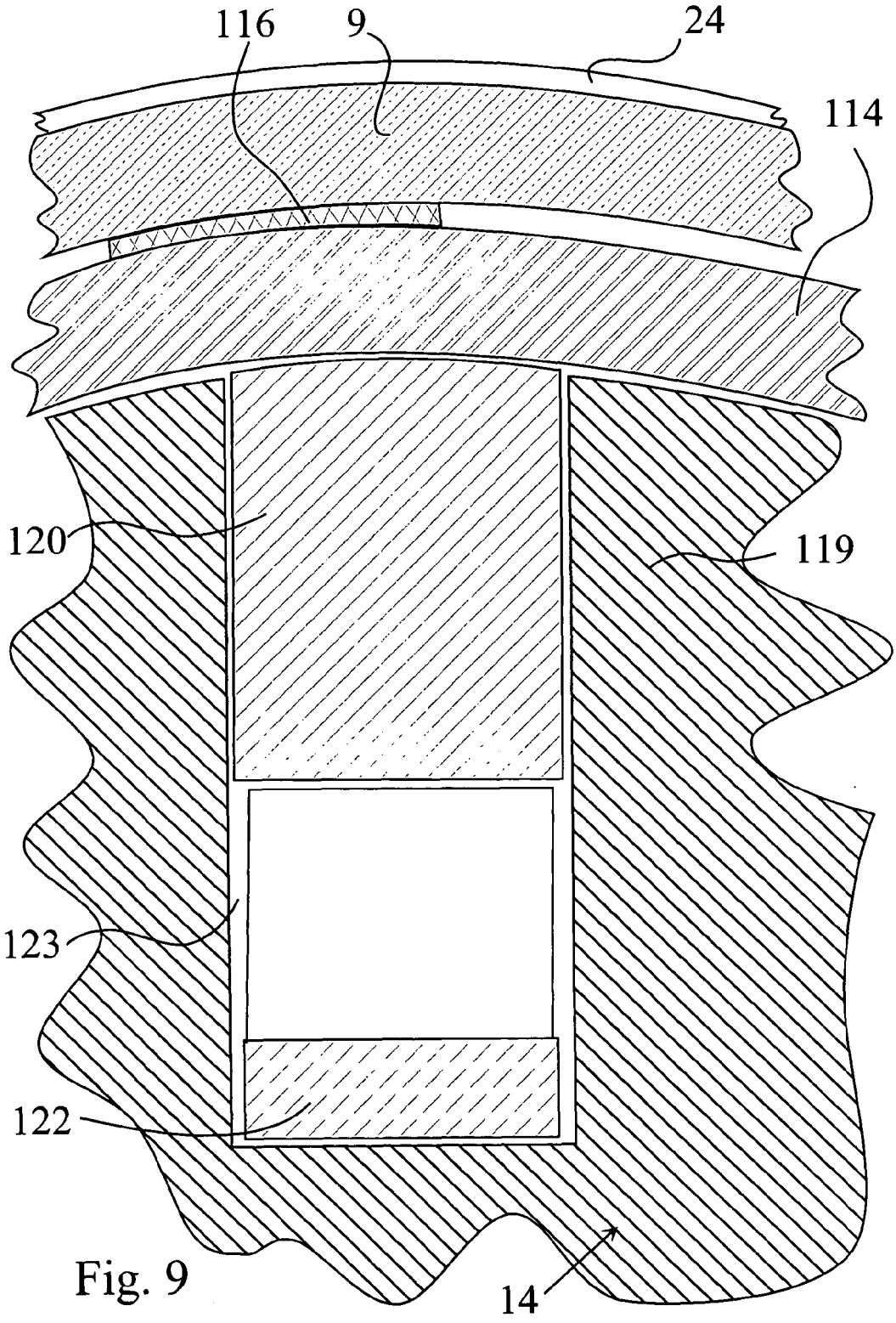
FIG. 9 is a cross-section of detail of a discharge vessel-electrode arrangement, utilising the electrode support of FIGS. 6 and 7 and the spring support of FIG. 8, in a view similar to FIG. 5.

As illustrated in FIG. 7, the foil 114 is rolled into a tubular form and it may be inserted into the inner tubular portion 9 in this rolled form, with the electrodes 116 and 118 turning towards the inner surface of the inner tubular portion 9. The foil 114 may be glued to the inner surface of the inner tubular portion 9. Alternatively, it is also foreseen to use spring means for pressing the foil 114 and thereby the electrodes 116 and 118 to the inner tubular portion 9. For example, the electrode support 14 in the form of the foil 114 may surround a spring support 119, the latter shown separately in FIG. 8. This spring support 119 is a tubular body similar to the electrode support 14 shown in FIG. 3, and holding a number of springs 122. A bore 128 along its central axis may receive the exhaust tube 10 of the discharge vessel when inserted into the inner tubular portion 9. As best perceived from FIG. 9, the springs 122 are mechanically supported by the spring support 119, for example by embedding them in grooves 123. Spacers 120 may be also provided between the springs 122 and the foil 114, in order to provide a more uniform distribution of the pressure from the springs 122 onto the surface of the foil 114. It is suggested to use an equal number of springs 122 and electrodes 116 and 118, and to position the springs 122 directly below the associated electrodes 116 and 118, but they may be also slightly displaced relative to each other, as shown in FIG. 9. The advantage of the foil 114 as compared with the cylinder 21 is a simpler manufacturing and wiring of the electrodes 116 and 118. If the foil 114 is glued to the inside of the inner tubular portion 9, the lamp may be very lightweight. On the other hand, the use of a spring support 119 may offer the advantages of easier assembly.

The invention is not limited to the shown and disclosed embodiments, but other elements, improvements and variations are also within the scope of the invention. For example, it is clear for those skilled in the art that the exhaust tube of the discharge vessel may also have a different form and location, for example at the joining of the inner and outer tubular portions of the discharge vessel. Also, the springs need not be made separately from the spacers, and a single body made of an insulating material may function as a spring and the mechanical support of the electrode.

The invention claimed is:

1. A dielectric barrier discharge lamp comprising a discharge vessel, the discharge vessel enclosing with a wall of the discharge vessel a discharge volume filled with discharge gas, and having a phosphor layer within the discharge volume, a first set of interconnected electrodes and a second set of interconnected electrodes, the first and second set of electrodes being isolated from the discharge volume by at least one dielectric layer, at least one of the dielectric layers being constituted by the wall of the discharge vessel, both the first and second set of electrodes being located external to the discharge vessel.

2. The lamp of claim 1, in which the discharge vessel comprises an outer tubular portion having an internal surface, an inner tubular portion having an outward surface, the outer tubular portion surrounding the inner tubular portion, the discharge volume being enclosed between the internal surface of the outer tubular portion and the outward surface of the inner tubular portion.

3. The lamp of claim 2, in which the electrodes are located at an internal surface of the inner tubular portion.

4. The lamp of claim 3, in which the first and second set of electrodes are formed as elongated conductors extending along a principal axis of the inner tubular portion.

5. The lamp of claim 4, in which the elongated conductors associated to the first and second set of electrodes are distributed along the internal surface of the inner tubular portion uniformly and alternating with each other.

6. The lamp of claim 4, in which the elongated conductors are metal stripes or metal bands.

7. The lamp of claim 2, in which the phosphor layer covers any of the outward surface of the inner tubular portion or the internal surface of the outer tubular portion.

8. The lamp of claim 2, in which the outward surface of the inner tubular portion comprises a reflective layer reflecting in any of the UV or visible wavelength ranges.

9. The lamp of claim 2, in which an electrode support is inserted within the inner tubular portion, and the electrodes are mechanically supported by the electrode support.

10. The lamp of claim 9, in which the electrode support is a tubular body made of an electrically insulating material and inserted into the inner tubular portion.

11. The lamp of claim 9, in which the electrode support is a plate made of an electrically insulating flexible material, which is rolled into a tubular form and inserted into the inner tubular portion.

12. The lamp of claim 2, in which the inner tubular portion comprises spring means for pressing the electrodes to the internal surface of the inner tubular portion.

13. The lamp of claim 12, in which the spring means are mechanically supported by an electrode support.

14. The lamp of claim 13, in which the electrode support is a tubular body comprising elongated grooves parallel to a principal axis of the tubular body, and the spring means are embedded in the grooves.

15. The lamp of claim 12, in which an electrically insulating spacer is inserted between the spring means and the electrode associated to the respective spring means.

16. The lamp of claim 12, in which the spring means are mechanically supported by a spring support, and the electrodes are mechanically supported by an electrode support surrounding the spring support.

17. The lamp of claim 1, in which the discharge vessel is made of glass.

18. The lamp of claim 2, in which the wall thickness of the inner tubular portion is approx. 0.5 mm.

19. The lamp of claim 2, in which the distance between the internal surface of the outer tubular portion and the outward surface of the inner tubular portion is 3-11 mm.

20. The lamp of claim 2, in which the inner tubular portion comprises an exhaust tube communicating with the discharge volume.

21. The lamp of claim 20, in which one end of the outer tubular portion is closed, and the exhaust tube extends along a central principal axis of the inner tubular portion, so that a free end of the exhaust tube is opposite to the closed and of the outer tubular portion.

22. A dielectric barrier discharge lamp apparatus comprising a discharge vessel, the discharge vessel enclosing with a wall of the discharge vessel a discharge volume filled with discharge gas, and having a phosphor layer within the discharge volume, a first set of interconnected electrodes and a second set of interconnected electrodes, the first and second set of electrodes being isolated from the discharge volume by at least one dielectric layer, at least one of the dielectric layers being constituted by the wall of the discharge vessel, an AC power source connected to the first and second set of interconnected electrodes, both the first and second set of electrodes being located external to the discharge vessel.

23. The apparatus of claim 22, in which the AC power source delivers a voltage of 1-5 kV on an AC frequency of 50-200 kHz.

24. A discharge vessel for a dielectric barrier discharge lamp, the discharge vessel enclosing a sealed discharge volume filled with discharge gas, and comprising an outer tubular portion having an internal surface, an inner tubular portion surrounding at least one associated electrode, the inner tubular portion having an outward surface, the outer tubular portion surrounding the inner tubular portion, the sealed discharge volume being enclosed between the internal surface of the outer tubular portion and the outward surface of the inner tubular portion.

25. The discharge vessel of claim 24, in which the outer tubular portion and the inner tubular portion are substantially concentric with each other.

26. The discharge vessel of claim 24, in which the distance between the internal surface of the outer tubular portion and the outward surface of the inner tubular portion is 3-11 mm.

27. The discharge vessel of claim 24, in which the discharge vessel has a phosphor layer within the sealed discharge volume.

28. The discharge vessel of claim 24, in which the inner tubular portion comprises an exhaust tube communicating with the discharge volume.

29. The discharge vessel of claim 28, in which one end of the outer tubular portion is closed, and the exhaust tube extends along a central principal axis of the inner tubular portion, so that a free end of the exhaust tube is opposite to the closed end of the outer tubular portion.

30. A dielectric barrier discharge lamp comprising a discharge vessel, the discharge vessel enclosing with a wall of the discharge vessel a discharge volume filled with discharge gas, and having a phosphor layer within the discharge volume, the discharge vessel comprising an outer tubular portion having an internal surface, an inner tubular portion having an outward surface, the outer tubular portion surrounding the inner tubular portion, the discharge volume being enclosed between the internal surface of the outer tubular portion and the outward surface of the inner tubular portion, the discharge lamp further comprising a first and a second set of interconnected electrodes located external to the discharge vessel, the electrodes being isolated from the discharge volume by at least one dielectric layer, at least one of the dielectric layers being constituted by the wall of the discharge vessel.

* * * * *